US005782256A

United States Patent [19]

Bradley

[11] Patent Number: 5,782,256

[45] Date of Patent: Jul. 21, 1998

[54] CONTOURED FOOT FOR AMBULATORY AID

[76] Inventor: Paul M. Bradley, 1710 57th NW, Apt. 412, Seattle, Wash. 98108

[21] Appl. No.: 642,490

[22] Filed: May 3, 1996

[51] Int. Cl.[6] ..... A45B 9/04

[52] U.S. Cl. ..... 135/77; 135/84; 248/188.9

[58] Field of Search ..... 135/67, 68, 77, 135/82, 84; 248/188.8, 188.9, 188.2

[56] References Cited

U.S. PATENT DOCUMENTS

| | | | |
|---|---|---|---|
| D. 349,144 | 7/1994 | Greene . | |
| 2,888,022 | 5/1959 | Fanning | 135/82 |
| 3,080,601 | 3/1963 | Kramcsak, Jr. | 248/188.8 X |
| 3,738,674 | 6/1973 | Pauls . | |
| 3,868,122 | 2/1975 | Negi . | |
| 3,948,535 | 4/1976 | Negi . | |
| 4,098,283 | 7/1978 | Tritle, Jr. . | |
| 4,899,771 | 2/1990 | Wilkinson . | |
| 4,964,430 | 10/1990 | Janis . | |
| 5,042,764 | 8/1991 | Carpinella et al. | 248/188.2 |
| 5,103,850 | 4/1992 | Davis . | |
| 5,120,227 | 6/1992 | Born . | |
| 5,224,506 | 7/1993 | Allen et al. | 135/67 |
| 5,318,058 | 6/1994 | Zimmerman . | |
| 5,353,825 | 10/1994 | Davis . | |
| 5,464,574 | 11/1995 | Davis . | |

FOREIGN PATENT DOCUMENTS 8201315 4/1982 WIPO .

OTHER PUBLICATIONS

O1 Carex Advertisement: Ambulatory Aids, p. 17.

*Primary Examiner*—Lanna Mai

*Attorney, Agent, or Firm*—Christensen O'Connor Johnson Kindness PLLC

[57] ABSTRACT

A foot (12) for attachment to a bottom end of a leg (18) of a walker or other ambulatory aid. The foot includes a tubular collar (24) with a central passage (26) that receives the leg. A ski-shaped base (28) projects from the bottom of the collar, generally orthogonally relative to the central axis of the collar. The base extends further in the forward direction to form an extended ramp-angle tip section (30). A frusto-conical bottom ground engaging surface (34) of the base slopes upwardly from a central lower-most area (60) of the base towards the left and right sides and towards the front and rear ends of the base. The outer perimeter edge (36) of the base is thus raised relative to the lower-most area of the base, particularly at the extended tip section. The foot also includes an internal expansion bolt assembly (46) to secure the foot onto the bottom of the leg.

18 Claims, 4 Drawing Sheets

CONTOURED FOOT FOR AMBULATORY AID

FIELD OF THE INVENTION

The present invention relates to ambulatory aids for use by the disabled, and more particularly to walkers.

BACKGROUND OF THE INVENTION

Ambulatory aids such as walkers, crutches and canes have various forms of feet or tips which make alternating or sliding contact with the floor when in use. Conventional walkers have rubber tips which many users have difficulty maneuvering over carpet edges, sidewalk seams and other impediments. Clearing such elevated obstacles requires lifting the walker, which may be difficult for some users. Failure to clear these obstacles can potentially lead to a loss of balance.

One conventional walker foot alleviates some of these problems. The SkiGlide™, available from Carex Company, is made of nylon and includes a rectangular ski-shaped base which curves upwardly at the front edge of the ski. The bottom surface of the base is flat from side to side. While this device may assist with the forward maneuvering of the walker over impediments, it does not assist in sideways maneuvering. In addition, the nylon material wears out quickly and is not securely fastened to the walker.

SUMMARY OF THE INVENTION

The present invention discloses a foot for attachment to legs of walkers or other ambulatory aids. The foot has an attachment portion configured as a cylindrical upper portion into which the end of a leg of an ambulatory aid can be slid. The foot can then be securely fastened to the leg by tightening an expansion bolt assembly which is secured to the base of the foot and is insertable into the hollow end of the leg. The end of the leg is securely retained in hoop tension between the cylindrical upper portion of the foot and the expansion bolt assembly. The foot's lower base portion has a bottom ground-engaging surface which is contoured to slope upwardly from a central lower-most area towards the left and right sides and towards the front and rear ends. In a preferred embodiment, the bottom ground-engaging surface is frustoconically shaped. This configuration overcomes the shortcomings of prior art devices by allowing easy sliding of the walker forwardly, rearwardly and laterally and in any other direction over carpet edges, sidewalk seams and other elevation impediments.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
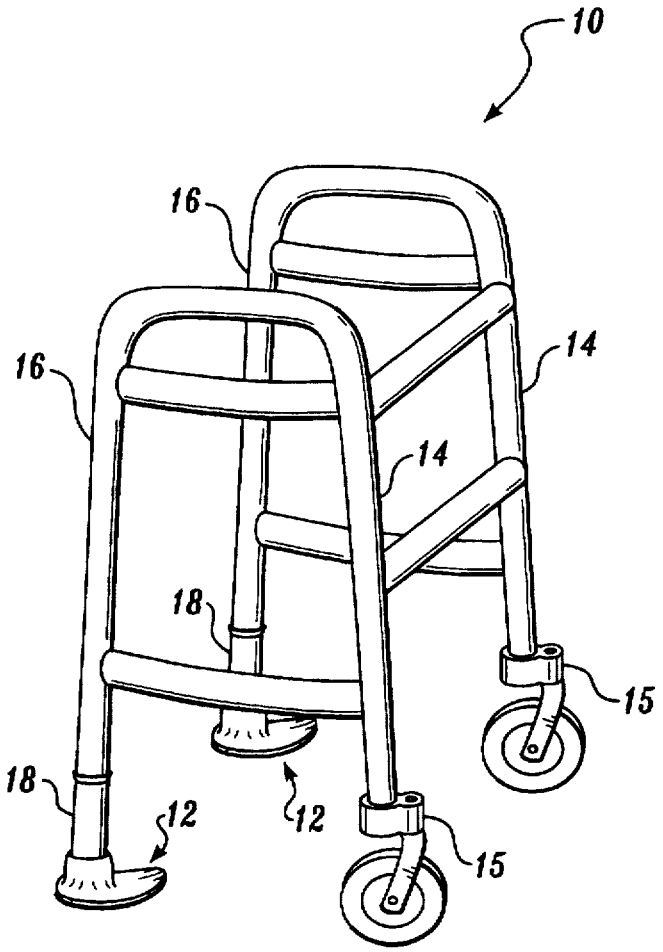
FIG. 1 is a perspective view of a conventional walker which has been provided with two feet constructed in accordance with the present invention.

A conventional walker 10 that has been provided with two rear feet 12 constructed in accordance with a preferred embodiment of the present invention is shown in FIG. 1. The walker includes two front legs 14 and two rear legs 16. Each of the front legs 14 includes a lower wheel attachment 15, and each of the rear legs 16 includes a lower extension leg section 18 to which the feet 12 are secured.

Figure 2:
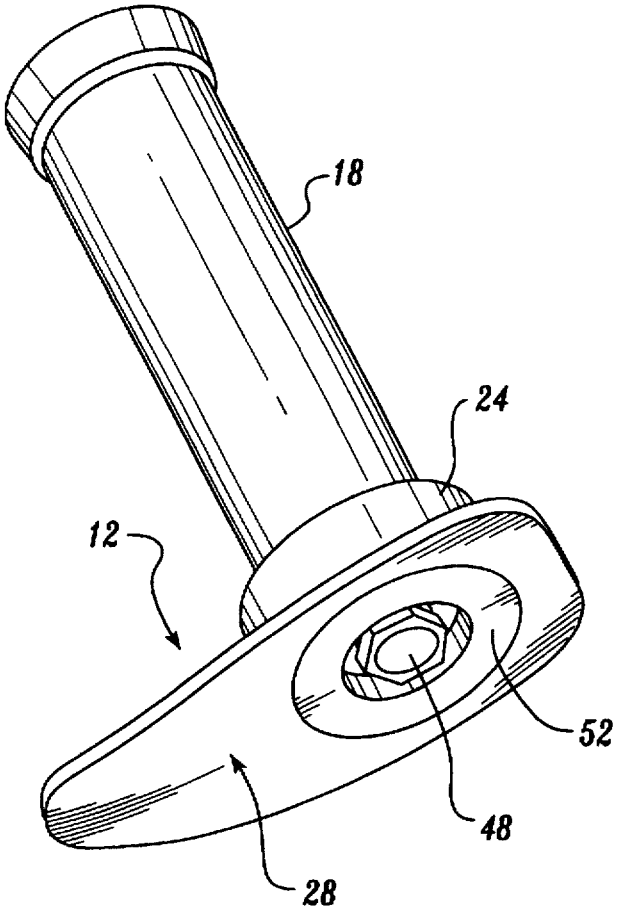
FIG. 2 is a perspective view of a foot constructed in accordance with the preferred embodiment of the invention attached to the lower leg extension section of the walker of FIG. 1.
Figure 3:
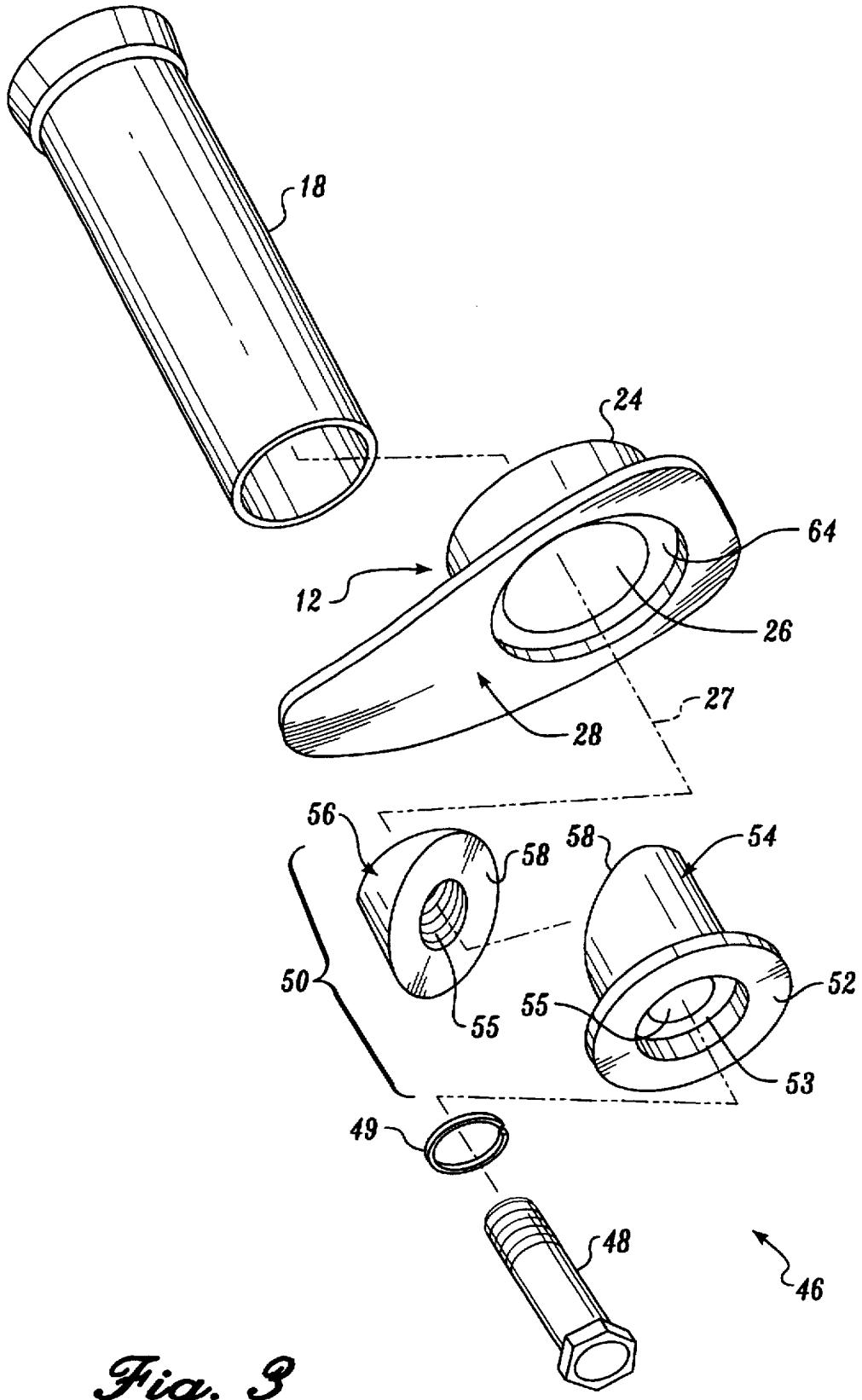
FIG. 3 is an isometric exploded view of the foot and leg extension section of FIG. 2.
Figure 4:
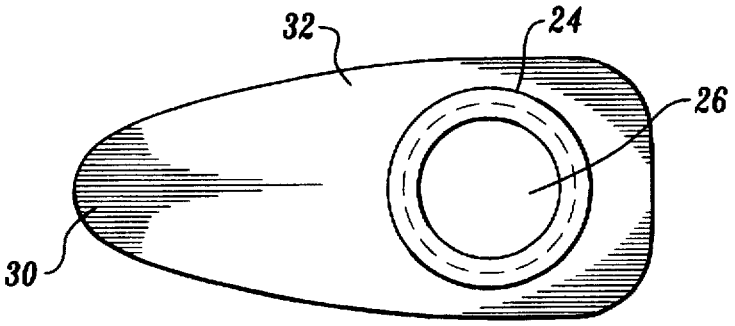
FIG. 4 is a top elevation view of the preferred embodiment of the invention.
Figure 5:
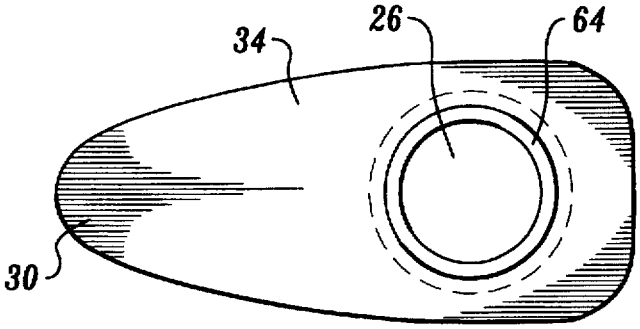
FIG. 5 is a bottom elevation view of the preferred embodiment of the invention.
Figure 6:
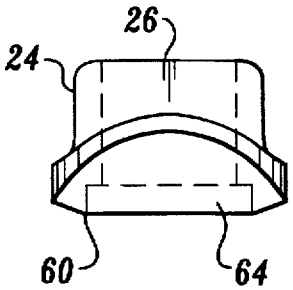
FIG. 6 is a front elevation view of the preferred embodiment of the invention.
Figure 7:
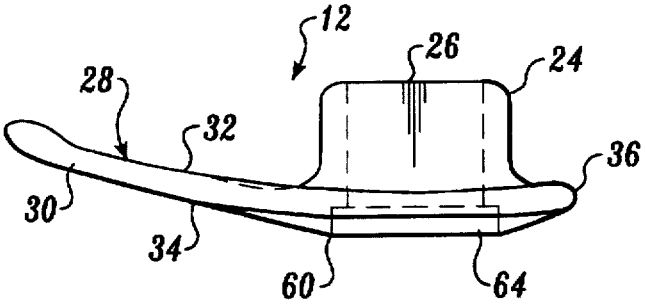
FIG. 7 is a side elevation view of the preferred embodiment of the invention, with the opposite side view being substantially a mirror image thereof.
Figure 8:
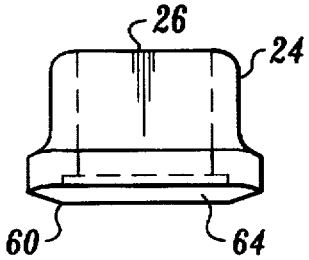
FIG. 8 is a rear elevation view of the preferred embodiment of the invention.

FIGS. 2 and 3 show the preferred embodiment of the foot 12 attached to a lower leg extension 18. The foot 12 has a tubular collar 24 with a central passage 26 that axially and slidably receives the extension leg section 18. The collar 24 and extension leg section 18 cooperatively define a longitudinal axis 27. A contoured extended ramp-angle, ski-shaped base 28 projects from the bottom of the collar 24, and is oriented generally orthogonally relative to the longitudinal axis 27 of the passage 26. To secure the foot 12 onto the bottom of the leg extension 18, the foot 12 includes an, internal expansion bolt assembly 46.

The expansion bolt assembly 46 includes a bolt 48, a lock washer 49 and an eccentric extension plug assembly 50. The eccentric extension plug assembly 50 includes diagonally cut cylindrical plug segments 54 and 56. Plug segments 54 and 56 combine and form an internally threaded passage 55. The portion of the internal passage 55 in plug segment 54 is smooth, while that in plug segment 56 is threaded. The assembly 50 is threaded onto the shaft of the bolt 48 with the washer 49 being secured therebetween. The assembly 50 has an enlarged head portion 52 located on the plug segment 54. A countersunk annular recess 53 is formed axially in the end of the head 52 about the passage 55. The recess 53 receives the head of the bolt 48 when the bolt is tightened into the assembly 50.

An annular countersunk recess 64 is also formed axially in the bottom surface of the base 28 of the foot 12 about the central passage 26. This recess 64 receives the head 52 of the plug segment 54 when the foot 12 is assembled to the walker 10. The bolt 48 is then tightened, resulting in an eccentric expansion of the circumference of at least a portion of the plug 50 as plug segment 54 slides relative to plug segment 56 along abutting angled faces 58. Such sliding can occur because the portion of the internal passage 55 within the plug segment 54 is wider than the shaft of bolt 48, while the portion of the internal passage 55 within the plug segment 56 is threaded to securely fit the threads of the shaft of the bolt 48. The sliding expansion results in a tensile force being exerted on the walls of the extension leg section 18 and the collar 24 of the foot 12, as the wall of the tubular extension leg section 18 is ovalized toward the collar 24 of the foot 12. This secure capturing of the extension leg section 18 prevents the foot 12 from becoming loose from the leg due to deformation of the leg.

As can best be seen with reference to FIGS. 4, 5, 6, 7 and 8, the base 28 of the preferred embodiment of the foot 12 extends from all sides of the collar 24, but extends further in the forward direction to form an extended ramp-angle ski-shaped tip section 30. As can best be seen in FIG. 7, the base 28 has a slight conical bowl shape, having a concave upper surface 32 and a convex bottom ground engaging surface 34. The bottom ground-engaging surface is a double contoured surface, and preferably a frusto-conical surface. The bottom ground engaging surface 34 has a flat central lower-most area 60 defined by the recess 64 and the head 52 of the plug 50. The contour of the bottom ground engaging surface 34 slopes upwardly from the lower-most area 60 in all radial directions from the recess 64, i.e., towards the left and right sides and towards the front and rear ends of the base 28. In other words, the contour of the base 28 results in the outer perimeter edge 36 of the base 28 being raised in elevation relative to the lower-most area 60 of the base 28, particularly at the extended tip section 30. This elevation of the outer perimeter edge 36 allows the base 28 to slide smoothly over elevated protuberances or other ground deformities.

While a frustoconical ground-engaging surface 34 has been disclosed, it should be readily apparent that other contours are possible within the scope of the present invention. For instance, the ground-engaging surface could be defined by any surface of revolution, such as conical, egg-shaped, pear-shaped or semi-spherical. Further, a truncated pyramid could be utilized. However, the smooth contours and gentle slope of the frustoconical contour of the illustrated embodiment, with the extended and further elevated ski tip section, is preferred for ease of sliding over ground contour changes.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A foot for attachment to a leg of an ambulatory aid, comprising:

a body having an attachment portion for securement to the leg, and an elongate base portion defining a longitudinal axis, the base portion defining elongate left and right sides oriented along the direction of the longitudinal axis, front and rear ends, and a bottom ground-engaging surface with a lower-most area immediately below the attachment portion, wherein the bottom ground-engaging surface is contoured to slope upwardly from the lower-most area towards the left and right sides and towards the front end.

2. The foot of claim 1 wherein:

the bottom ground-engaging surface is frustoconically contoured.

3. The foot of claim 1 wherein:

the front end extends further from the lower-most area towards the front end than towards the left and right sides so as to form an extended ramp-angle defined by a front tip section.

4. The foot of claim 3 wherein:

the extended front tip section curves upwardly to form a ski tip.

5. The foot of claim 1 wherein:

the attachment portion is cylindrical and defines a vertical axis; and the base portion is oriented orthogonally relative to the attachment portion and extends radially on all sides of the attachment portion.

6. The foot of claim 1 wherein:

the lower-most area is centrally located on the bottom-ground engaging surface.

7. The foot of claim 1 wherein:

the lower-most area defines a flat plane.

8. The foot of claim 1 wherein:

the attachment portion includes means for selectively securing the attachment portion to the leg of an ambulatory aid.

9. The foot of claim 8, wherein the means for selectively securing the attachment portion comprises:

an internal plug engagable with the base portion of the foot and receivable within a hollow end of the leg of the ambulatory aid; and means for circumferentially tensioning the hollow end of the leg and the received plug together.

10. The foot of claim 9 wherein:

the attachment portion of the foot has a tubular configuration and surrounds the outside of the hollow end of the leg; and the means for circumferentially tensioning comprises an expansion bolt assembly included as part of the internal plug which is diametrically expandable to place the hollow end of the leg in tension between the expansion bolt assembly and the attachment portion of the foot.

11. A foot for attachment to a leg of an ambulatory aid, comprising:

a body having an attachment portion for securement to the legs and an elongate base portion defining a longitudinal axis, the base portion defining elongate left and right sides oriented along the direction of the longitudinal axis, front and rear ends, and a bottom ground-engaging surface with a lower-most area immediately below the attachment portion, wherein the bottom ground-engaging surface is contoured to slope upwardly from the lower-most area towards the left and right sides and towards the front and rear ends, and wherein the bottom ground-engaging surface extends further from the lower-most area towards the front end than towards the left and right sides, so as to form an extended front tip section.

12. The foot of claim 11 wherein:

the bottom ground-engaging surface defines a frustoconical shape.

13. The foot of claim 11 wherein:

the lower-most area is centrally located on the bottom-ground engaging surface.

14. The foot of claim 11 wherein:

the attachment portion includes means for securing the attachment portion to the leg of an ambulatory aid.

15. A foot for attachment to a leg of an ambulatory aid, comprising:

a body having an attachment portion for securement to the leg, and an elongate base portion defining a longitudinal axis, the base portion defining elongate left and right sides oriented along the direction of the longitudinal axis, front and rear ends, and a bottom ground-engaging surface with a lower-most area, wherein the bottom ground-engaging surface is frustoconical shaped so as to slope upwardly from the lower-most area towards the left and right sides and towards the front and rear ends.

16. The apparatus of claim 15 wherein:

the front end extends further than the left and right sides so as to form an extended front tip section.

17. The apparatus of claim 15 wherein:

the attachment portion includes means for selectively securing the attachment portion to the leg of an ambulatory aid.

18. A support for attachment to the lower end of the leg of an ambulatory aid, comprising:

a ground engaging base;

an expandable plug comprising first and second annular plug segments each defining an abutting diagonal sliding surface secured to the base and projecting upwardly therefrom to be receivable within a hollow end of the leg of the ambulatory aid, the expandable plug being diametrically expandable to place the hollow end of the leg in tension and secure the base to the leg.

* * * * *

UNITED STATES PATENT AND TRADEMARK OFFICE

CERTIFICATE OF CORRECTION

PATENT NO. : 5,782,256
DATED : July 21, 1998
INVENTOR(S) : P.M. Bradley

It is certified that error appears in the above-identified patent and that said Letters Patent is hereby corrected as shown below:

| COLUMN | LINE | |
|---|---|---|
| [56] Pg. 1, col. 2 | Refs. Cited (U.S. patents, item 16) | "5,464,574" should read --5,465,745-- |
| 4 (Claim 11, | 26 line 4) | "legs" should read --leg,-- |

Signed and Sealed this

Eighth Day of December, 1998

Bruce Lehman

*Attest:*

BRUCE LEHMAN

*Commissioner of Patents and Trademarks*

*Attesting Officer*